United States Patent [19]

Patterson

[11] 4,059,856

[45] Nov. 29, 1977

[54] SWIMMING POOL GUTTER

[76] Inventor: James A. Patterson, P.O. Box 2894, Columbus, Ohio 43204

[21] Appl. No.: 691,446

[22] Filed: June 1, 1976

[51] Int. Cl.[2] ..... E04H 3/16; E04H 3/18; F16L 22/02

[52] U.S. Cl. ..... 4/172.17; 4/172.15; 4/172.18; 210/169

[58] Field of Search ..... 4/172.11, 172.15, 172.18, 4/172; 210/169

[56] References Cited

U.S. PATENT DOCUMENTS

| | | | |
|---|---|---|---|
| 2,932,397 | 4/1960 | Ogden | 240/169 |
| 3,386,107 | 6/1968 | Whitten, Jr. | 4/172.17 |
| 3,668,714 | 6/1972 | Baker | 4/172.17 |
| 3,815,160 | 6/1974 | Baker | 4/172.17 |
| 3,829,911 | 8/1974 | Bishop | 4/172.17 |
| 3,918,107 | 11/1975 | Whitten et al. | 4/172.17 |
| 3,923,230 | 12/1975 | Patterson et al. | 4/172.17 X |

*Primary Examiner*—Henry K. Artis
*Attorney, Agent, or Firm*—Wood, Herron & Evans

[57] ABSTRACT

A swimming pool gutter including a combined gutter conduit and a sealed filtered water inlet conduit at the bottom of the gutter conduit. The gutter is formed from two sheet metal members joined by two exposed welds to form a deep-walled gutter capable of accommodating water surges and waves without flooding and having a sealed filtered water inlet combined therewith.

9 Claims, 4 Drawing Figures

SWIMMING POOL GUTTER

BACKGROUND OF THE INVENTION

This invention relates to swimming pool gutters and, more particularly, to a deep-walled sheet metal gutter having a combined filtered water inlet conduit.

The gutter system is one of the most important elements of swimming pool design, construction, and operation. The gutter must not only perform its intended function of continuously skimming the pool to keep the pool clear of dirt and debris but it must also be pleasing in appearance and add to the aesthetic appeal of the pool. In addition, the gutter system is one of the most significant factors in the cost of building the pool. That is, gutters are typically formed from performed sheets of a corrosion resistant metal such as stainless steel and aluminum, which are welded together either at the factory or at the pool site. The cost of forming the sheets and of welding them together at either the factory or the pool site contributes greatly to the cost of the pool. The design of the gutter is thus an important factor in the overall cost of the pool.

Prior to the Ogden Patent, U.S. Pat. No. 2,932,397, the plumbing for swimming pools had usually been buried in the soil surrounding the swimming pool, that is, the conduits for filtered water were located well below ground and included a main conduit extending around the perimeter of the pool and spaced outlet conduits connected from the main conduit to the wall of the swimming pool, usually spaced down several feet from the top of the swimming pool. Further, gutters usually were provided with drains spaced every 20 feet or so, the drains having conduits connecting them for the flow of water from the gutter back to the filter.

The Ogden invention substantially eliminated all of the underground plumbing by providing a gutter extending around the perimeter of the pool, one of the walls of the gutter (preferably the inner wall of the gutter) being formed as a filtered or fresh water conduit, the conduit having outlets spaced around the pool to direct water from the conduit downwardly into the pool. This system which permits the plumbing to be exposed for ease of installation and repair has enjoyed wide spread acceptance.

In the present practice of making and installing the system, a gutter coping including an upstanding wall and a horizontal bottom wall have been factory formed and installed at the site of the pool. A conduit has also been factory formed from a channel to which a plate has been welded along two continuous welds to close the channel and form the conduit. That conduit, as the inner wall of the gutter, is welded along a continuous line at the site of the pool to the previously formed and installed coping to complete the installation of the gutter. The gutter and coping are usually formed in short sections as, for example, 10 feet sections, and are transversely welded at the site in order to form the continuous gutter for pools which are at least 25 meters in length and 42 feet wide. After installation, the conduit is filled with water under high pressure to see whether any leaks have been created through the welding process. Any leaks appearing are immediately repaired.

While the foregoing installation methods and structures have been used in hundreds of pools and have been considered to be a vast improvement over practices prior to the Ogden patent, they nevertheless have given rise to some problems which the present invention seeks to eliminate.

First, the structure necessarily results in concealed inaccessible welds. As stated above, adjacent short sections are transversely welded together and the composite conduit is then welded to the coping. At each place where a transverse weld overlies the coping to which the conduit is attached, that section of transverse weld is inaccessible. Should a leak develop in the transverse weld, it would be difficult to detect in the first place and when detected, it would be difficult to repair because of its inaccessibility. In addition, when the conduit is mounted in place overlying a concrete pool wall, for example, at least one of the two continuous welds sealing the conduit, the outer one, becomes concealed by the concrete or other underlying material. Should a leak develop along that weld, after installation, it too would be difficult to locate and repair. Moreover, the structure presents welding difficulties which require the use of skillful, experienced welders to make straight, true installations at the site of the pool thereby adding to the cost of construction.

Second, the structure is relatively shallow and has little capacity for accommodating surges or waves in the pool. The gutter system described in the Ogden patent is a perimeter gutter that provides for a continuous skimming flow of water over the top of the gutter wall into the gutter trough. Under normal conditions, the gutter provides efficient skimming action. However, when a heavy surge of water or a wave is encountered, as occurs when a group of swimmers enters the pool, the additional flow of water over the top of the gutter exceeds the gutter's capacity to drain the water away and results in flooding of the gutter and backwashing of the debris in the gutter into the pool.

Various attempts have been made to design gutters having the capacity to accommodate surges and waves without flooding. Typical are those gutters described in U.S. Pat. Nos. 3,668,712; 3,668,714; and 3,815,160; all to Baker. Although these gutters are designed to provide for skimming action without flooding under surge conditions, they are complicated in construction and require a number of sheet metal elements which must be welded together resulting in the need for a number of welds some of which are hidden and inaccessible.

An objective of the present invention is to provide a new method of forming a gutter conduit system of the type disclosed in the Ogden patent which not only eliminates the disadvantages of the practices described above but which additionally introduces considerable economies into the swimming pool construction and introduces surge capacity into the gutter itself. More specifically, the present invention allows the construction of a relatively deep-walled swimming pool gutter having a combined filtered water inlet conduit from sheet metal of standard width on conventional sheet metal forming equipment.

Another object of the invention is to provide a swimming pool gutter having the advantages described above which requires only two continuous welds which are exposed and readily accessible such that leaks occurring during construction may be easily seen and repaired.

Another object of the invention is to provide a swimming pool gutter wherein the required welding is easier and requires less in the way of skills in the welder than has heretofore been available.

Another object of the invention is to provide a swimming pool gutter wherein the preformed gutter elements have mostly square corners thereby allowing convenient stacking of the elements for storage and transportation.

Another object of the invention is to provide a swimming pool gutter wherein the inside wall of the filtered water inlet conduit has a V-shaped recess for conveniently directing water upwardly or downwardly into the pool without the necessity of welding a plate to the inlet conduit.

BRIEF DESCRIPTION OF THE INVENTION

These and other objects are accomplished in accordance with the invention by providing a relatively deep-walled gutter including a first member having a vertical back wall, a horizontal bottom wall, and a vertical inside wall; and a second member having a horizontal bottom wall and a vertical wall spaced inwardly from the back wall of the first member to define the gutter conduit. The vertical wall of the second member forms a part of the inside wall of the gutter over the top of which water may flow from the pool into the gutter conduit. The two members are joined together by a first weld joining the vertical wall of the second member and vertical inside wall of the first member, and a second weld joining the horizontal bottom wall of the second member to the first member. The first weld is exposed to the pool side of the gutter and the second weld is exposed to the gutter conduit. There are only two welds neither of which is hidden.

The joinder of the two elements defines not only a relatively deep gutter conduit having a large surge capacity but also a filtered water inlet conduit at the bottom of the gutter conduit for introducing filtered water into the pool. The two elements are formed from standard width sheet metal, cut to sizeif necessary, on conventional sheet metal forming equipment.

The vertical inside wall of the first member defines the vertical inside wall of the filtered water inlet conduit and is provided with a V-shaped recess. Holes are drilled in the recess to direct water upwardly, downwardly, or horizontally into the pool, as desired.

Other objects and advantages of the invention will become apparent from the following detailed description, reference being had to the accompanying drawings.

DETAILED DESCRIPTION OF THE INVENTION

Figure 1:
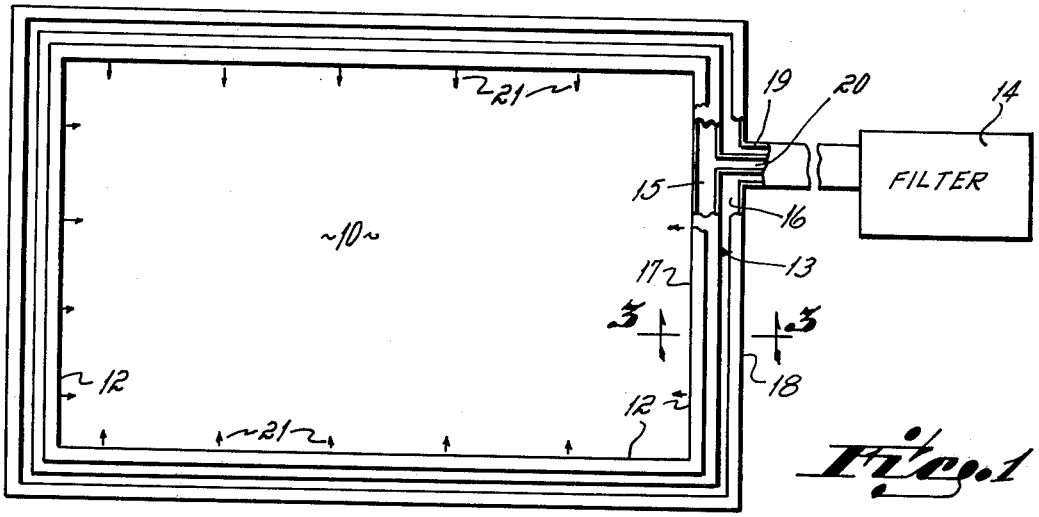
FIG. 1 is a swimming pool of the type to which the invention is applied.

A typical swimming pool to which the invention is applied is illustrated in FIG. 1 and includes a pool cavity 10 defined by side walls 12. At the top of the side walls is the conduit system 13 which includes the gutter of the present invention. The conduit system 13 is connected to a filter 14 which receives contaminated water from the pool, filters it, and discharges the filtered water under pressure into the pool.

The conduit system 13 includes an inner peripheral conduit 15 and an open gutter 16 which has an inner wall 17 and a back wall 18. The gutter is a gravity feed system which is in communication with a return conduit 19 emptying into the filter 14. Fresh water from the filter 14 is fed into a conduit 20 which is connected to the inner peripheral conduit 15 to direct fresh water into the pool. A series of outlets 21 in the inner wall of the conduit 15 direct the water into the pool 10.

Figure 2:
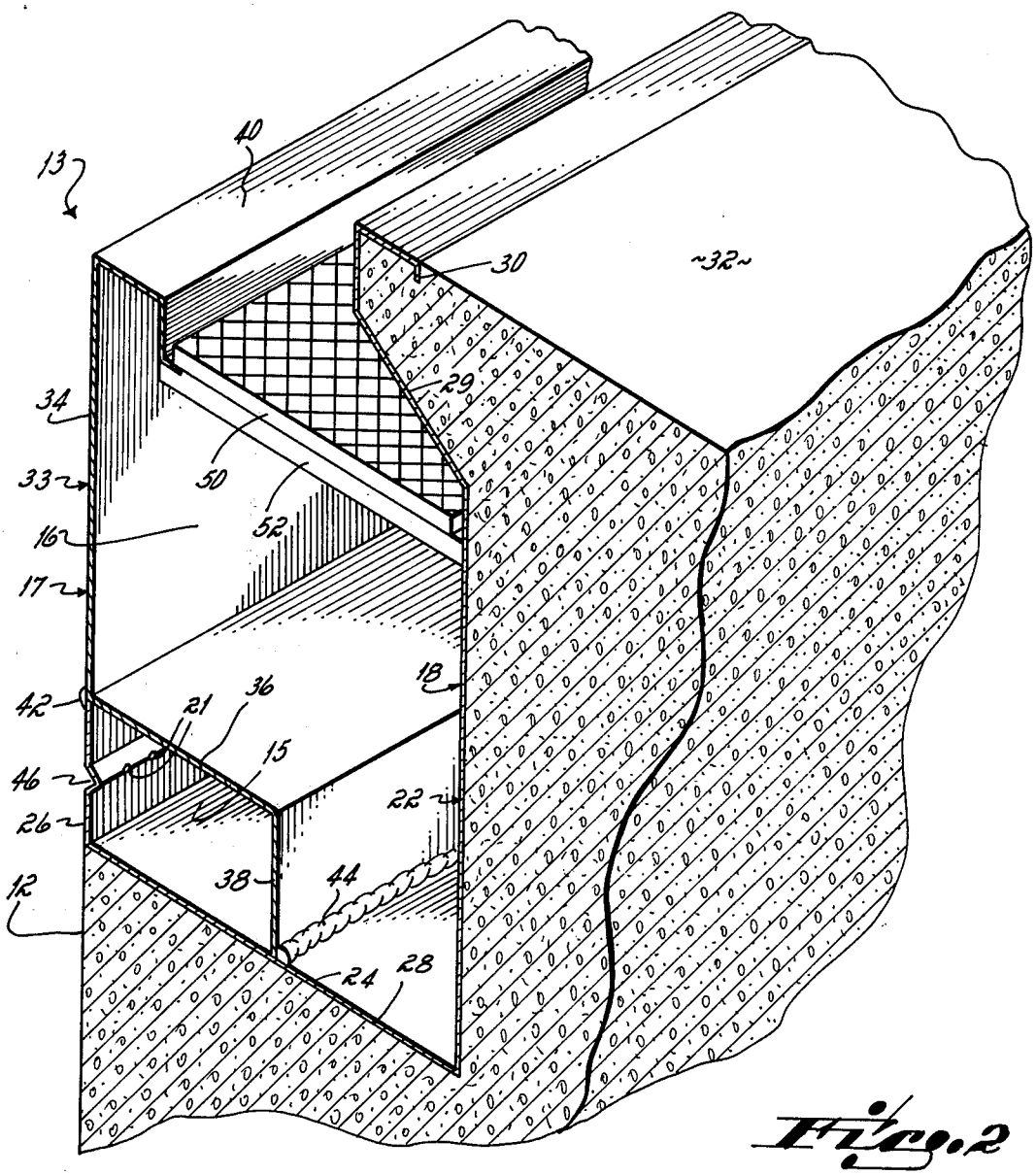
FIG. 2 is a perspective view of one embodiment of the invention.
Figure 3:
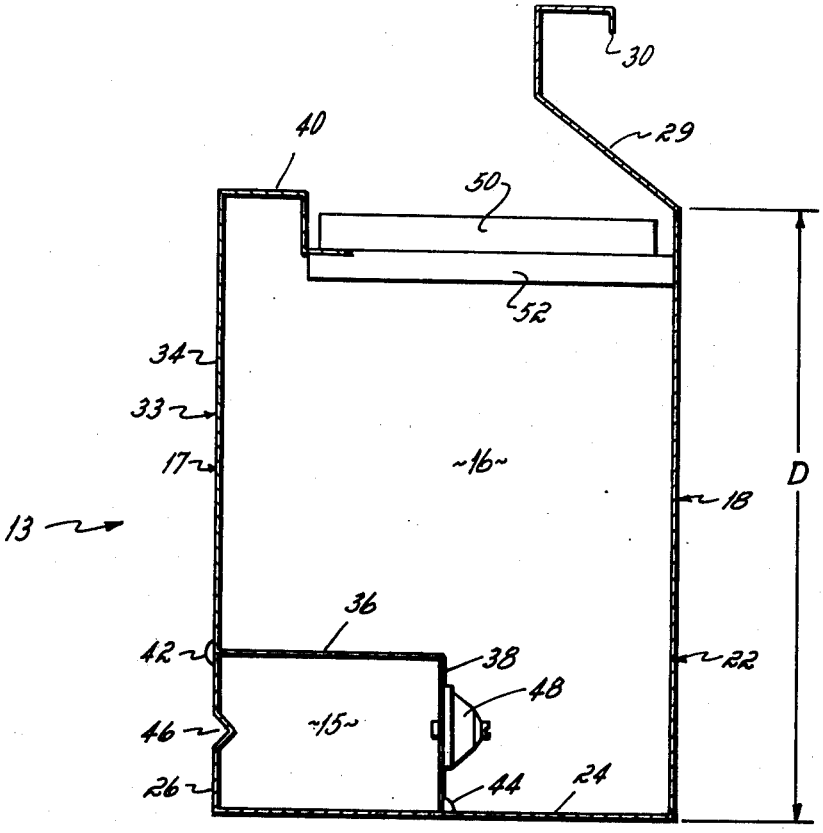
FIG. 3 is a cross-sectional view of the embodiment shown in FIG. 2 taken along line 3—3 of FIG. 1.

Referring to FIGS. 2 and 3, the gutter 13 includes a first sheet metal member 22 including the vertical back wall 18, a horizontal bottom wall 24, and a vertical inside wall 26. The bottom wall 24 sits on a shelf 28 in the concrete wall structure such that the vertical inside wall 26 is flush with the inner concrete surface which forms the pool side walls 12 below the gutter conduit system 13 extending to the floor of the pool. The vertical back wall 18 includes an inwardly extending portion 29 terminating in a lip 30 which is embedded in the concrete deck 32 surrounding the pool 10 and the gutter system 13 to provide the deck 32 with a slight overhang.

The gutter 13 further includes a second sheet metal member 33 having an upstanding inside wall 34, a horizontal wall 36, and a second vertical wall 38. The two elements 22 and 33 are disposed such that the inside wall 34 of the second member is flush with the vertical inside wall 26 of the first member to define together the inside wall 17 of the gutter 13. The inside wall 34 of the second member terminates in a free-standing top 40 over which water may flow into the gutter conduit 16. When the water level in the pool is maintained at the level of the top 40 of the wall 34 under normal conditions, the top 40 provides for continuous skimming action in which water from the pool flows across the top 40 of the wall 34 and into the gutter conduit 16 to be channeled back through the return conduit 19, through the filter 14, and into the inlet conduit 20 for introduction into the pool. Dirt and debris washed into the gutter by this skimming action are thus carried to the filter to be removed. Alternatively, the inside wall 34 may be provided with a skimmer located below the top 40, such as is disclosed in U.S. Pat. No. 3,363,767 to Ellis, or a series of spaced slots, as is disclosed in U.S. Pat. No. 3,668,712 to Baker, in which cases the water level is maintained at the lower level of the skimmer or slots. In any case, however, when swimmers enter the pool and the water level rises or when they generate water surges and waves, there is an increased flow of water over the top 40 into the conduit 16 which is channeled into the filter.

The two inside walls 26 and 34 are joined by a continuous longitudinal weld 42 exposed at the pool side of the gutter. The second vertical wall 38 of the second member is joined to the bottom wall 24 of the first member intermediate the inside wall 26 and back wall 18 by a second continuous longitudinal weld 44 exposed at the gutter conduit 16. The two sheet metal members thus define the gutter conduit 16 and the sealed filtered water inlet conduit 15 disposed at the bottom of the gutter conduit 16 substantially below the top 40 of the inside gutter wall 34.

The inside wall 26 of the first member is provided with a horizontal V-shaped recess 46 which extends around the perimeter of the pool. Peripherally spaced apertures 21 for discharging filtered water from the inlet conduit 15 into the pool 10 are formed by drilling holes along the V-shaped recess to permit the introduction of water either upwardly or downwardly or horizontally into the pool in the manner described in U.S. Pat. No. 3,890,230 to Patterson. The holes may vary in size from ¼ inch, 5/16 inch or 7/16 inch diameter holes, with the number of holes and their size being determined by the number of gallons per minute of water to be discharged into the pool. The present invention permits this method of introducing filtered water into the pool without necessity of a welded plate as in the aforesaid patent.

Mounted on and spaced along the second vertical wall 38 of the second member are spray nozzles 48, FIG. 3. These nozzles communicate through the wall 38 with the filtered water under pressure in the inlet conduit 15 and provide for the distribution of a fine, high pressure spray into the gutter conduit 16. The construction of these nozzles is well-known in the art. The nozzles are peripherally spaced and disposed along the wall 38 and are so directed to provide a continuous flush of filtered water along the gutter conduit to wash dirt and debris to the filter.

The conduit 13 is also provided with a grating 50 at the top thereof to prevent swimmers from placing their arms and legs in the conduit. The gratings 50 come in sections and are supported at their ends by spaced cross bars 52 which extend from the second member 34 to the back wall 18 of the first member 22 and are welded thereto. The grating, of course, allows for the continuous flow of water from the pool into the gutter conduit 16.

Figure 4:
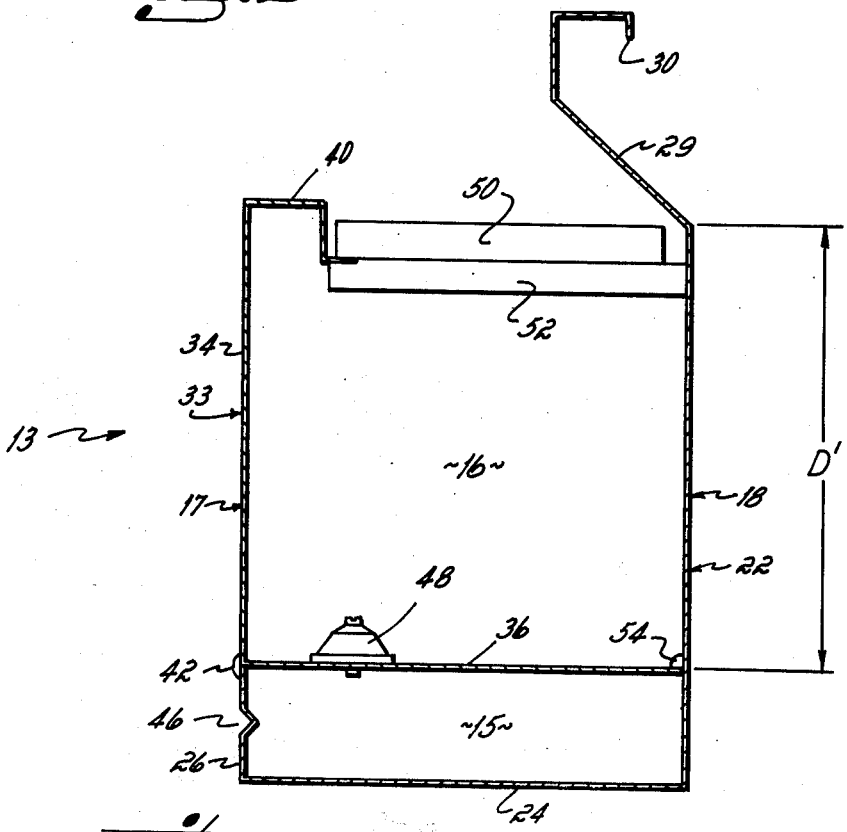
FIG. 4 is a cross-sectional view similar to that of FIG. 3 showing another embodiment of the invention.

In the other form of the invention, as shown in FIG. 4, the first member 22 includes the vertical back wall 18, the bottom wall 24, and the vertical inside wall 26 which has the longitudinal V-shaped recess 46 therein. The second member, however, includes only the vertical wall 34 and the bottom wall 36. The second member is joined to the first by the first continuous longitudinal weld 42 at the juncture of the vertical inside walls 26 and 34, as in the embodiment shown in FIGS. 2 and 3, and a second continuous longitudinal weld 54 at the juncture of the bottom wall 36 and vertical back wall 18 of the first member. The two members thus form the gutter conduit 16 and the sealed inlet conduit 15 at the bottom thereof. Again, the first weld 42 is exposed to the pool and the second weld 54 is exposed to the gutter conduit 16. The second member includes the top 40 over which water may flow into the gutter conduit 16 and is provided with spaced cross bars 52 for supporting the gutter grating 50. The inlet conduit 15 functions in the same manner as the embodiment shown in FIGS. 2 and 3 except that the conduit is now larger and provides for flushing of the gutter conduit 16 through upwardly directed spray nozzles 48 spaced along the bottom wall 36 and communicating with the filtered water under pressure in the inlet conduit 15.

In either embodiment, the first and second members are factory formed as elongated sections, stacked one upon another, and transported to the pool site. The first members are placed end to end around the pool perimeter and transversely welded to their adjacent sections to form a continuous conduit around the perimeter of the pool and into the filter. Similarly, the second members are transversely welded around the pool perimeter to their adjacent sections and are welded to the first members along the two continuous longitudinal welds 42, 44 to form the gutter conduit and inlet conduit extending around the perimeter of the pool. At the pool corners, of course, the members are mitered and welded to form a leak tight joint there. Since neither member was welded prior to assembly at the pool site, they have not been subjected to any localized heating which would cause them to be warped when brought to the pool site. Moreover, as a result of the present invention, there are no hidden welds. After welding, the inlet conduit is then pressure tested to be sure that the welds are leak-tight. Since all the welds are exposed, any leaks which develop during the pressure testing can be easily discerned and easily repaired.

As described above, the gutter construction provides for a relatively deep-walled gutter conduit having a relatively large surge capacity. That is, the depth of gutters made in accordance with the Ogden patent typically ranges from 4 to 8 inches, that is, the distance from the top of the inside gutter wall to the bottom of the gutter conduit. However, the depth D of the gutter shown in FIG. 3 is 16 inches and the depth D′ of the gutter shown in FIG. 4 is 12 inches. Thus, the gutter of the present invention is substantially deeper and of greater capacity than the Ogden structure. However, the gutter may still be economically formed from standard 48 inch wide sheet material. Moreover, the gutter members may be formed on conventional die forming equipment wherein the square corners are formed by the die contacting the sheet metal at a 45° angle. The gutters of the depths described and shown in FIGS. 3–5 cannot be formed from a single piece of sheet metal since their perimeters are greater than 48 inches, and secondly, the corners at the juncture of walls 18 and 24 and walls 24 and 26 cannot be formed on conventional equipment because of interference from walls 34 and 18, respectively. The present invention therefore offers a relatively deep-walled gutter conduit having a relatively large surge capacity which can be formed from standard width sheet material on conventional equipment and easily assembled with only two exposed welds to provide an economically constructed gutter having the advantages heretofore described and which adds to the overall aesthetic appeal of the pool.

Thus having described the invention, what is claimed is:

1. A gutter for swimming pool comprising, in combination, a first sheet metal member including a vertical back wall, a horizontal bottom wall, a vertical inside wall; and a second sheet metal member including a vertical wall in spaced relation to said back wall and a horizontal wall spaced substantially below the top of said vertical wall of said second member defining with said first member a gutter conduit, over the top of said vertical wall of said second member water may flow from the pool into said gutter conduit;

said vertical wall of said second member being joined to said vertical inside wall of said first member by a continuous, longitudinal weld exposed at the pool side thereof to form the inside wall of said gutter;

said horizontal wall of said second member being joined to said first member by a second continuous, longitudinal weld exposed at the gutter conduit side thereof to form at the bottom of said gutter conduit substantially below the top of said vertical wall of said second member a sealed inlet conduit adapted to receive filtered water under pressure for introduction into the pool, said vertical inside wall of said first member forming the inside wall of said inlet conduit.

2. The gutter of claim 1 wherein said horizontal wall of said second member is joined to the vertical back wall of said first member by said second weld.

3. The gutter of claim 1 wherein said second member further includes a second vertical wall extending downwardly from said horizontal wall and serially connected thereto and being joined to said horizontal bottom wall of said first member by said second weld at a point intermediate said back wall and said inside wall of said first member.

4. The gutter of claim 1 wherein said gutter conduit is connected to a first conduit means communicating with a filter and recirculation system for conducting liquid collected in said gutter conduit to said system, and said inlet conduit is connected to a second conduit means communicating with said system for returning filtered water to said inlet conduit for introduction into the pool.

5. The gutter of claim 1 wherein said inside wall of said first member includes a horizontal V-shaped recess extending around the perimeter of the pool and a plurality of peripherally spaced apertures therein for introducing water from said inlet conduit into the pool.

6. The gutter of claim 1 further including a plurality of peripherally spaced spray nozzles in fluid flow communication with said inlet conduit for flushing said gutter conduit with water under pressure from said inlet conduit.

7. The gutter of claim 1 wherein said gutter conduit is at least about 12 inches deep.

8. The gutter of claim 7 wherein said first member and said second member are formed from sheets having a width of about 48 inches.

9. The gutter of claim 8 wherein said gutter conduit is about 16 inches deep.

* * * * *